US011859885B2

(12) United States Patent
Larson et al.

(10) Patent No.: US 11,859,885 B2
(45) Date of Patent: Jan. 2, 2024

(54) REFRIGERANT CIRCUIT WITH REDUCED ENVIRONMENTAL IMPACT

(71) Applicant: Refrigerated Solutions Group LLC, Hudson, WI (US)

(72) Inventors: William Craig Larson, Lino Lakes, MN (US); Narasimha Sapta Sailesh Krovvidi, Woodbury, MN (US); Nicholas Scott Huppert, Ellsworth, WI (US); Brian McCain, New Richmond, WI (US)

(73) Assignee: REFRIGERATED SOLUTIONS GROUP LLC, Hudon, WI (US)

( * ) Notice: Subject to any disclaimer, the term of this patent is extended or adjusted under 35 U.S.C. 154(b) by 0 days.

(21) Appl. No.: 17/746,886

(22) Filed: May 17, 2022

(65) Prior Publication Data

US 2023/0023638 A1 Jan. 26, 2023

Related U.S. Application Data

(60) Provisional application No. 63/225,208, filed on Jul. 23, 2021.

(51) Int. Cl.
*F25B 49/02* (2006.01)
*F25B 5/02* (2006.01)

(52) U.S. Cl.
CPC ..... *F25B 49/02* (2013.01); *F25B 5/02* (2013.01)

(58) Field of Classification Search
CPC ..... F25B 49/02; F25B 5/02
See application file for complete search history.

(56) References Cited

U.S. PATENT DOCUMENTS

| | | | | |
|---|---|---|---|---|
| 6,213,194 | B1 * | 4/2001 | Chrysler | F25B 41/20 257/722 |
| 7,467,524 | B2 | 12/2008 | Brutscher et al. | |
| 7,836,713 | B2 | 11/2010 | Lifson et al. | |
| 8,299,653 | B2 | 10/2012 | Rockenfeller et al. | |
| 9,160,258 | B2 | 10/2015 | Rockenfeller et al. | |
| 9,714,786 | B2 | 7/2017 | Rockenfeller et al. | |
| 9,733,009 | B2 | 8/2017 | Lee et al. | |
| 9,746,226 | B2 | 8/2017 | Lee et al. | |
| 9,777,956 | B2 | 10/2017 | Lee et al. | |
| 9,816,739 | B2 * | 11/2017 | Tambovtsev | F25B 6/02 |
| 9,857,103 | B2 | 1/2018 | Lee et al. | |
| 9,982,927 | B2 | 5/2018 | Lee et al. | |
| 10,174,978 | B2 | 1/2019 | Elstrm | |
| 10,420,425 | B2 | 9/2019 | Resch | |
| 10,429,111 | B2 | 10/2019 | Austin, Jr. | |
| 10,627,145 | B2 | 4/2020 | Khalili et al. | |

(Continued)

*Primary Examiner* — Henry T Crenshaw
(74) *Attorney, Agent, or Firm* — Moore & Van Allen PLLC

(57) ABSTRACT

A refrigeration system configured to receive a refrigerant is provided, as well as a walk-in refrigeration unit configured to utilize said system. The refrigeration system comprises: a power source, a condenser unit, an evaporation unit, a plurality of compressors, wherein each of the plurality of compressors is communicably coupled to the condenser unit, and a plurality of expansion devices, wherein each of the plurality of expansion devices is communicably coupled to the evaporation unit. The system is configured to receive an A3 refrigerant having a Global Warming Potential (GWP) value less than 10.

13 Claims, 1 Drawing Sheet

(56) References Cited

U.S. PATENT DOCUMENTS

| | | | | |
|---|---|---|---|---|
| 10,655,911 | B2 | 5/2020 | Turner et al. | |
| 10,663,200 | B2 | 5/2020 | Izadi-Zamanabadi | |
| 10,760,842 | B2 | 9/2020 | Wolgamot et al. | |
| 10,871,315 | B2 | 12/2020 | Kerstner et al. | |
| 11,060,767 | B2 | 7/2021 | Fredslund et al. | |
| 11,092,369 | B2 | 8/2021 | Austin, Jr. | |
| 2014/0008044 | A1* | 1/2014 | Kim | F25D 11/02 29/890.052 |
| 2018/0031301 | A1* | 2/2018 | Kim | F25B 39/04 |
| 2018/0106505 | A1* | 4/2018 | Mislak | F25B 5/00 |
| 2018/0251665 | A1* | 9/2018 | Junge | F25B 5/02 |
| 2019/0063791 | A1 | 2/2019 | Durand | |
| 2019/0383537 | A1 | 12/2019 | Austin, Jr. | |
| 2020/0025396 | A1 | 1/2020 | Leon | |
| 2020/0240693 | A1 | 7/2020 | Khalili et al. | |
| 2020/0363111 | A1 | 11/2020 | Wolgamot et al. | |
| 2021/0270504 | A1 | 9/2021 | Parrabbi | |
| 2022/0404081 | A1* | 12/2022 | Vaisman | F25B 41/31 |

* cited by examiner

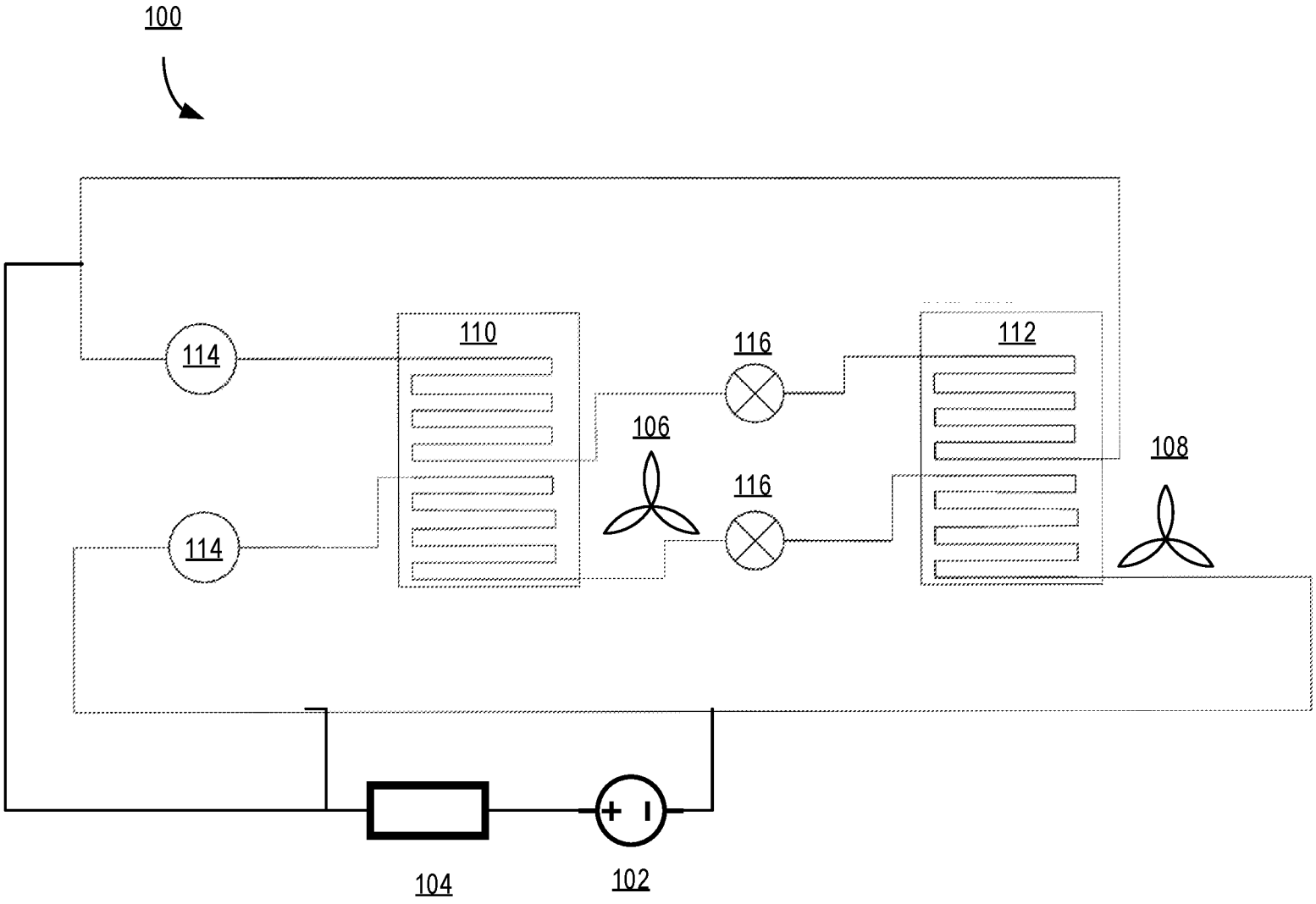
100
114
114
110
106
116
116
112
108
102
104

REFRIGERANT CIRCUIT WITH REDUCED ENVIRONMENTAL IMPACT

CROSS-REFERENCE TO RELATED APPLICATIONS

This application claims the benefit of U.S. Provisional Application No. 63/225,208 filed on Jul. 23, 2021, the entirety of which is incorporated herein by reference.

FIELD OF THE DISCLOSURE

The present disclosure relates to refrigerant circuits for use in walk-in refrigeration units and more specifically, a single refrigeration system comprising multiple integrated refrigerant circuits.

BRIEF SUMMARY

The following presents a simplified summary of one or more embodiments of the disclosure in order to provide a basic understanding of such embodiments. This summary is not an extensive overview of all contemplated embodiments and is intended to neither identify key or critical elements of all embodiments, nor delineate the scope of any or all embodiments. Its sole purpose is to present some concepts of one or more embodiments in a simplified form as a prelude to the more detailed description that is presented later.

A refrigeration system configured to receive a refrigerant is provided. The refrigeration system comprises: a power source; a condenser; a plurality of compressors, wherein each of the plurality of compressors comprises a compressor input and a compressor output and wherein each compressor output is communicably coupled to the condenser; and an evaporator.

In some embodiments, the evaporator comprises a plurality of evaporator inputs and evaporator outputs.

In some embodiments, the refrigeration system further comprises a plurality of expansion devices, wherein each of the plurality of expansion devices comprises an expansion device input and an expansion device output and wherein each expansion device output is communicably coupled to one of the plurality of evaporator inputs.

In some embodiments, the condenser comprises a plurality of condenser inputs and condenser outputs and each condenser output is communicably coupled to one of the plurality of expansion device inputs.

In some embodiments, the refrigerant has a Global Warming Potential (GWP) value less than 10.

In some embodiments, the refrigerant is classified as an A3 refrigerant.

In some embodiments, the refrigeration system further comprises a maximum charge of 5.3 ounces of the A3 refrigerant.

In some embodiments, the refrigeration system further comprises a controller, wherein the controller is configured to activate the plurality of compressors based on a sensed temperature, a change in temperature or one or more temperature thresholds.

A walk-in refrigeration unit and a method of cooling a walk-in refrigeration unit are also provided. The walk-in refrigeration unit comprises: one or more refrigeration systems configured to receive a refrigerant, wherein each refrigeration system comprises: a power source; a condenser; a plurality of compressors, wherein each of the plurality of compressors comprises a compressor input and a compressor output and wherein each compressor output is communicably coupled to the condenser; and an evaporator.

In one example, a refrigeration system configured to receive a refrigerant is provided, the refrigeration system comprising: a single power source; a single condenser coupled to the power source; a plurality of compressors, wherein each of the plurality of compressors comprises a compressor input and a compressor output and wherein each compressor output is communicably coupled to the condenser; a plurality of expansion devices communicably coupled to the condenser; and a single evaporator communicably coupled to the plurality of expansion devices.

In another example, a walk-in refrigeration unit is provided, the unit comprising: one or more refrigeration systems configured to receive a refrigerant, wherein each refrigeration system comprises: a single power source; a single condenser coupled to the power source; a plurality of compressors, wherein each of the plurality of compressors comprises a compressor input and a compressor output and wherein each compressor output is communicably coupled to the condenser; a plurality of expansion devices communicably coupled to the condenser; and a single evaporator communicably coupled to the plurality of expansion devices.

In some embodiments, a combined refrigeration capacity of the one or more refrigeration circuits is equivalent to a total refrigeration capacity of the walk-in refrigeration unit. The features, functions, and advantages that have been discussed may be achieved independently in various embodiments of the present disclosure or may be combined with yet other embodiments, further details of which can be seen with reference to the following description and drawings.

BRIEF DESCRIPTION OF THE DRAWING

Having thus described embodiments of the disclosure in general terms, reference will now be made to the accompanying drawing, wherein:

The FIGURE is a block diagram illustrating the refrigeration system, in accordance with one embodiment of the present disclosure.

DETAILED DESCRIPTION

Embodiments of the present disclosure now may be described more fully hereinafter with reference to the accompanying drawings, in which some, but not all, embodiments of the disclosure are shown. Indeed, the disclosure may be embodied in many different forms and should not be construed as limited to the embodiments set forth herein; rather, these embodiments are provided so that this disclosure may satisfy applicable legal requirements. Like numbers refer to like elements throughout.

It should be understood that "communicably coupled," as used herein, encompasses components that are formed integrally with each other, or are formed separately and coupled together, for example, to allow the flow of refrigerant. Furthermore, "communicably coupled" encompasses components that are formed directly to each other, or to each other with one or more components located between the components that are communicably coupled together. Furthermore, "communicably coupled" encompasses components that are detachable from each other, or that are permanently coupled together. Furthermore, communicably coupled components encompasses components that retain at least some freedom of movement in one or more directions or may be rotated about an axis (e.g., rotationally coupled, pivotally coupled).

Also, it will be understood that, where possible, any of the advantages, features, functions, devices, and/or operational aspects of any of the embodiments of the present disclosure described and/or contemplated herein are combinable and/or included in any of the other embodiments of the present disclosure described and/or contemplated herein, and/or vice versa. In addition, where possible, any terms expressed in the singular form herein are meant to also include the plural form and/or vice versa, unless explicitly stated otherwise.

Embodiments of the present disclosure are directed to self-contained refrigeration systems which use A3 classified (according to the ISO817 Standard) refrigerants in a walk-in refrigeration unit. In one example, the refrigerant is R290 (i.e. propane), which is an ultra-low GWP (Global Warming Potential) refrigerant that, when used in refrigeration systems, both lowers the energy consumed and reduces global warming. Being that R290 is classified as a flammable refrigerant it is restricted in the amount that can be safely used in a refrigeration circuit. For example, the current charge limit R290 is 150 gm (5.3 oz) in the United States. This charge restriction typically limits the refrigeration capacity of systems employing R290 as a refrigerant. However, it is permitted to use multiple refrigeration circuits in a single refrigeration system to increase the refrigeration capacity of that system. As such, there exists a need for a single refrigeration system which is able to meet the refrigeration capacity of multiple refrigeration circuits. Embodiments of the present disclosure are directed to a single refrigeration system which integrates multiple refrigerant circuits using shared components, such as a single power source, condenser coil, and the like. Thus, the present disclosure provides a single refrigeration system which is able reach a high refrigeration capacity while utilizing the environmentally-friendly A3 refrigerant, thereby achieving a reduced environmental impact compared to a conventional refrigeration system.

The FIGURE provides a block diagram illustrating the refrigeration system 100, in accordance with one embodiment of the present disclosure. The refrigeration system 100 is configured for use in a refrigeration unit, such as a walk-in refrigeration unit. As used herein, a "refrigeration unit" may refer to any refrigerated device or appliance configured to maintain a temperature-regulated environment within an interior storage space or compartment. For example, a "refrigerator" may further include a freezer. The FIGURE depicts a power source 102 connected in series with a controller 104. The FIGURE further depicts two compressors 114 communicably coupled to two different inputs of a condenser 110. The two inputs of the condenser 110 lead to two different outputs, which are each communicably coupled to an expansion device 116. Each expansion device 116 is communicably coupled to a different input of an evaporator 112. The two inputs of the evaporator 112 lead to two different outputs, which are each communicably coupled to the two compressors 114. A condenser fan 106 is positioned near the condenser 110 and an evaporator fan 108 is positioned near the evaporator 112. The controller 104 and the power source 102 are communicably coupled to both compressors 114.

Generally, the refrigeration system 100 includes a single, shared power source 102, a shared controller 104, at least one condenser fan 106, at least one evaporator fan 108, a single or shared condenser 110, a single or shared evaporator 112, at least one compressor 114, and at least one expansion device 116. The power source 102 may comprise any direct current (DC) or alternating current (AC) voltage source and may provide power to the system components 104, 106, 108, 110, 112, 114, and 116. The controller 104 may be any ignition-proof electronic controller configured to provide logic and decisioning for the system 100. In one example, the controller is configured to activate the at least compressor 114. In one example, the presently disclosed system comprising multiple compressors 114, includes a controller configured to activate each compressor 114 sequentially, for example, for avoiding an excessive surge in amperage which would result from each compressor 144 activating simultaneously. In one example, the controller is configured to activate each compressor 114 sequentially based on a sensed temperature, a change in temperature or an event exceeding or falling below a temperature threshold.

The refrigeration system 100 may be configured to receive a refrigerant (not shown). The at least one expansion device 116, which may comprise a valve, may configured to relieve pressure from the liquid refrigerant, causing a temperature drop. In some embodiments, the at least one expansion device 116 may be controllable in order to adjust the flow of liquid refrigerant passing through it. The liquid refrigerant may then pass from an output of the expansion device 116 to an input of the evaporator 112. The at least one evaporator fan 108 may be positioned near the evaporator 112 and may configured to direct atmospheric air over the evaporator 112, causing evaporation of the liquid refrigerant.

In one example, the at least one compressor 114 is configured to pull cold, low-pressure gaseous refrigerant from the evaporator 112 into a compressor input. The at least one compressor 114 raises the temperature and pressure of the refrigerant and output the heated refrigerant into an input of the condenser 110. In one example, the at least one condenser fan 106 is positioned near the condenser 110 and is configured to direct atmospheric air over the condenser 110, causing the refrigerant to cool from a gaseous state to a liquid state. The refrigerant then flows from an output of the condenser 110 into an input of the at least one expansion device 116 for cooling.

In some embodiments, the system 100 comprises a plurality of compressors 114 connected in parallel between the outputs of the evaporator 112 and the inputs of the condenser 110. In some embodiments, the system 100 comprises a plurality of expansion devices 116 connected in parallel between the outputs of the condenser 110 and the inputs of the evaporator 112.

In some embodiments, the refrigeration system 100 may be configured for use in a walk-in refrigeration unit. In one example, a single refrigeration system 100 is sufficient to provide the total refrigeration capacity of the walk-in refrigeration unit, or alternatively, multiple systems 100 are installed in order to provide sufficient refrigeration capacity. In one example, refrigeration system 100 is configured within the refrigeration unit such that the condenser 110 and at least one condenser fan 106 are positioned outside of the temperature-regulated space or environment. In another example, evaporator 112 and at least one evaporator fan 108 are positioned inside of the temperature-regulated space or environment.

In some embodiments, the system 100 is configured to receive a refrigerant having a GWP (Global Warming Potential) value less than 10. Specifically, the system 100 is configured to receive R290 refrigerant (i.e. propane), which has a GWP value of 3. The current charge limit for R290 is 150 gm (5.3 oz) in the United States, and therefore the system 100 is configured to receive a charge less than 5.3 oz of R290 refrigerant. To determine the overall AWEF (Annual Walk-In Efficiency Factor) of the walk-in refrigeration unit when multiple systems 100 are integrated, the pressures and temperatures into the expansion devices 116 and out of the evaporator 112 for each system 100 are averaged, and the mass flow for each system 100, as well as the power consumption for each system 100, is totaled. These values may then be used to calculate a total refrigeration capacity and AWEF value.

It should be understood that while only one system configuration is depicted with respect to the FIGURES, these embodiments are non-limiting. It is envisioned that additional or alternative configurations may be included in the design of the refrigerant circuit, specifically depending on the specifications of the walk-in refrigeration unit. While certain exemplary embodiments have been described and shown in the accompanying drawings, it is to be understood that such embodiments are merely illustrative of and not restrictive on the broad disclosure, and that this disclosure not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A walk-in refrigeration unit comprising:

one or more refrigeration systems, each of the one or more refrigeration systems operatively coupled to a walk-in refrigeration unit, each of the one or more refrigeration systems configured to receive a refrigerant, wherein each refrigeration system comprises:

a power source;

a single condenser;

a plurality of compressors, wherein each of the plurality of compressors comprises a compressor input and a compressor output and wherein each compressor output is communicably coupled to the condenser;

a plurality of expansion devices; and a single evaporator shared by the plurality of expansion devices.

2. The walk-in refrigeration unit of claim 1, wherein the single evaporator comprises a plurality of evaporator inputs and evaporator outputs.

3. The walk-in refrigeration unit of claim 2, wherein each of the plurality of expansion devices is communicably coupled to the single evaporator.

4. The walk-in refrigeration unit of claim 3, wherein the single condenser comprises a plurality of condenser inputs and condenser outputs, wherein each condenser output is communicably coupled to one of the plurality of expansion device inputs.

5. The walk-in refrigeration unit of claim 1, wherein the refrigerant has a Global Warming Potential (GWP) value less than 10.

6. The walk-in refrigeration unit of claim 1, wherein the refrigerant is classified as an A3 refrigerant.

7. The walk-in refrigeration unit of claim 6, wherein the refrigeration system further comprises a maximum charge of 5.3 ounces of the A3 refrigerant.

8. The refrigeration system of claim 1, further comprising a controller, wherein the controller is configured to activate the plurality of compressors based on a sensed temperature, a change in temperature, or a temperature threshold.

9. The walk-in refrigeration unit of claim 1, wherein a combined refrigeration capacity of the one or more refrigeration systems is equivalent to a total refrigeration capacity of the walk-in refrigeration unit.

10. A method of cooling a walk-in refrigeration unit, the method comprising:

providing one or more refrigeration systems, each of the one or more refrigeration systems operatively coupled to a walk-in refrigeration unit, wherein each of the one or more refrigeration system comprises:

a refrigerant;

a single condenser;

a plurality of compressors, wherein each of the plurality of compressors comprises a compressor input and a compressor output and wherein each compressor output is communicably coupled to the single condenser;

a plurality of expansion devices; and a single evaporator shared by the plurality of expansion devices;

wherein the one or more refrigeration systems provides cooling to the walk-in refrigeration unit.

11. The method of claim 10, wherein each of the plurality of expansion devices comprises an expansion device input and an expansion device output and wherein each expansion device output is communicably coupled to one of a plurality of evaporator inputs of the single evaporator.

12. The method of claim 10, further comprising activating, via a controller, the plurality of compressors based on a sensed temperature.

13. A walk-in refrigeration unit comprising:

one or more refrigeration systems each of the one or more refrigeration systems operatively coupled to a walk-in refrigeration unit, each of the one or more refrigeration systems configured to receive a refrigerant, wherein each refrigeration system comprises:

a single power source;

a plurality of compressors coupled to the single power source, wherein each of the plurality of compressors comprises a compressor input and a compressor output and wherein each compressor output is communicably coupled to a single condenser;

a plurality of expansion devices communicably coupled to the single condenser; and a single evaporator communicably coupled to the plurality of expansion devices, wherein the refrigerant is propane with a maximum charge of 5.3 ounces.

* * * * *